United States Patent [19]

Sweeney et al.

[11] 4,205,609

[45] Jun. 3, 1980

[54] DIRECTIONAL FUZE SELECTOR APPARATUS FOR ARTILLERY DELIVERED MINES

[75] Inventors: Patrick E. Sweeney, Baltimore; John J. Critcher, Cockeysville, both of Md.

[73] Assignee: The United States of America as represented by the Secretary of the Army, Washington, D.C.

[21] Appl. No.: 922,399

[22] Filed: Jul. 5, 1978

[51] Int. Cl.[2] ..... F42B 23/26

[52] U.S. Cl. ..... 102/8

[58] Field of Search ..... 102/8

[56] References Cited

U.S. PATENT DOCUMENTS

| | | | |
|---|---|---|---|
| 4,030,418 | 6/1977 | Regber et al. | 102/8 |
| 4,040,354 | 8/1977 | Stern | 102/8 |
| 4,058,060 | 11/1977 | Dukic | 102/8 |

*Primary Examiner*—Charles T. Jordan

*Attorney, Agent, or Firm*—Nathan Edelberg; Robert P. Gibson; Max Yarmovsky

[57] ABSTRACT

A gravity sensing disc slide interrupter in combination with dual chambered detonating booster charges is used to automatically select one of a plurality of mine covers to be removed from a randomly ground oriented mine in order to insure maximum leathality against a target. Reliable selection of the mine cover to be explosively removed is accomplished by reduction of gap distance between the output side of a transfer lead charge and the input side of detonating fuze booster charges.

2 Claims, 5 Drawing Figures

DIRECTIONAL FUZE SELECTOR APPARATUS FOR ARTILLERY DELIVERED MINES

GOVERNMENTAL INTEREST

The invention described herein was made in the course of a contract with the U.S. Government and may be manufactured, used and licensed by or for the U.S. Government for governmental purposes without the payment to us of any royalty thereon.

BACKGROUND OF THE INVENTION

Various means have been used in the prior art to quickly and remotely disperse mines in a target area. One of the methods for accomplishing this was to eject a plurality of mines from an artillery fired shell. One of the problems with this type of distribution has been the inability to predict the final orientation of the mine after it landed upon the ground. Generally the mine has protective covers thereon to prevent inadvertant firing or damage thereto during the assembly and delivery phases. In order to achieve maximum effectiveness against an overhead target, the upside cover had to be removed. Some prior art devices have accomplished this by utilizing a target sensing device to initiate a primary explosive train which could selectively fire an explosive charge which removed the upside cover. A rolling ball gravity positioning interrupter element was interposed between a pair of canted detonator charges and a transfer lead charge. The ball would uncover the booster charge fuze that is selected and initiated to remove the cover in the upper position. One of the problems encountered with the prior art ball selector design was its extremely low reliability. In some instances, each of the booster detonator pair would fire causing the upside cover and downside cover to be blown off simultaneously. The simultaneous removal of the upside and downside covers would rotate the mine upward and away from the intended target thereby reducing the mines effectively leathality. Another reason for the low reliability of the prior art canted booster-ball interrupter design was the excessive gap existing between the output side of the transfer load charge and the input side of the detonating fuze booster member. The reliability of the aforementioned prior art design was also decreased because of the tortuous path that the explosive blast had to follow within the ball selector chamber before it got to the input side of angularly positioned detonating fuze boosters.

SUMMARY OF THE INVENTION

The present invention relates to a directional selector fuze apparatus for removal of the upside cover of artillery delivered mines. The present invention utilizes a stepped disc flat interrupter for positively covering an unselected mild detonating fuze booster and uncovering the selected detonating fuze booster used for firing a charge to remove the upside mine cover.

An object of the present invention is to provide a dual chamber directional fuze selector apparatus for randomly oriented artillery dispersed mines which will reliably remove a mine cover that is in an upside position for maximum terminal effect against a proximately positioned target.

Another object of the present invention is to provide a directional fuze selector apparatus for randomly oriented artillery dispersed mines which reduces the gap distances between the output side of a transfer lead charge and the input side of a selected mild detonating fuze (MDF) booster.

Another object of the present invention is to provide a directional fuze selector apparatus for randomly oriented artillery dispersed mines which insures a more direct path for a transfer lead blast into a booster chamber and into the input side of a parallel aligned MDF booster.

Another object of the present invention is to provide a gravity sensitive directional fuze selector apparatus for randomly oriented artillery dispersed mines which provides a more positive interrupter for an unselected MDF booster.

A further object of the invention is to provide a directional fuze selector apparatus for a dual chambered MDF booster which precludes the simultaneous firing of both MDF boosters.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENT

Figure 1:
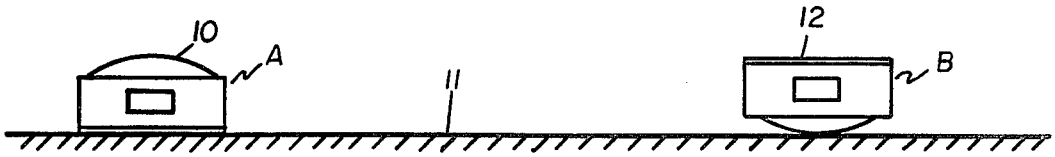
FIG. 1 is an elevational view of a randomly dispersed mine oriented in two different positions with respect to the ground.
Figure 2:
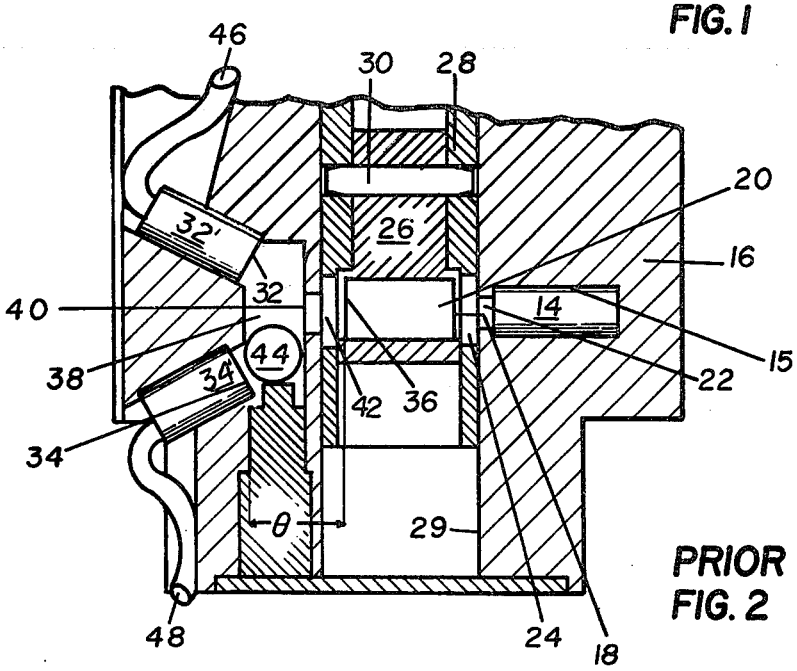
PRIOR ART FIG. 2
FIG. 2 is a partial cutaway cross-sectional view of a dual chambered primary mode explosive train of prior art directional fuze selector apparatus wherein the mine is in a first position "A" as shown in FIG. 1.
Figure 3:
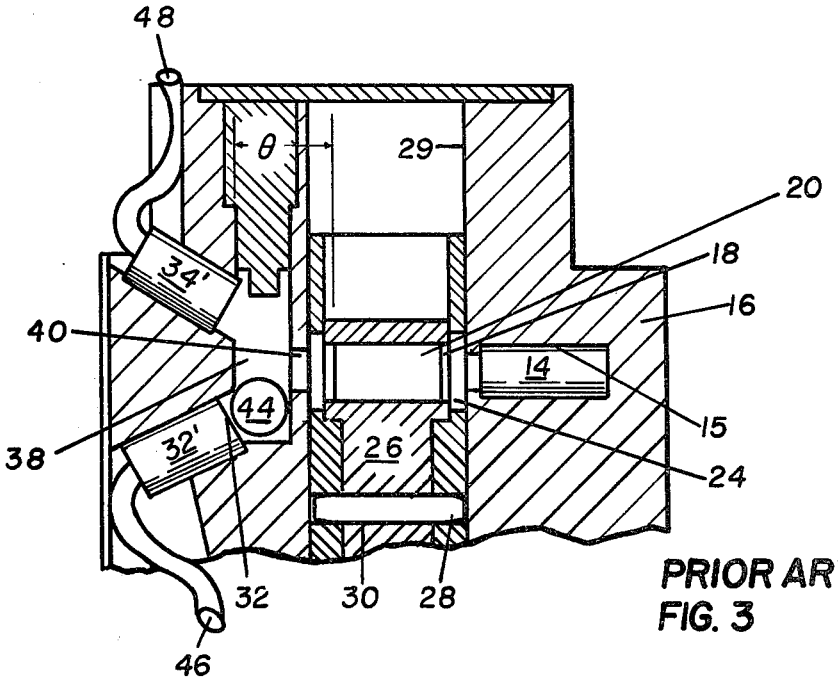
PRIOR ART FIG. 3
FIG. 3 is a partial cutaway cross-sectional view of the dual chambered primary mode explosive train of the prior art device in a second position "B" as shown in FIG. 1, wherein the mine is oriented 180° with respect to the ground.

The present invention will be better understood when the design of the prior art is first discussed. Referring now to FIGS. 1-3, two mine landing orientations are shown in FIG. 1. The first position "A" of the mine is shown with the round cover 10 of the mine disposed in an "up" position relative to ground surface 11. The second position "B" is shown with the flat cover 12 in an "up" position. The primary mode explosive train of the prior art comprises a microdetonator 14, located in microdetonator housing counterbore 15, transversely disposed in housing body member 16. Microdetonator 14 is axially aligned with the input side 18 of transfer lead charge 20 and communicates therewith through microdetonator body housing orfice 22 and axially aligned tubular transfer lead housing input orifice 24. Transfer lead charge 20 is transversely positioned in transfer lead charge housing 26 which is in turn fixedly attached to transfer lead charge tubular member 28, located in body housing central bore 29, by groove pin 30. Transfer lead charge 20 output communicates with the input sides 32 and 34 of two MDF angularly positioned booster charges 32′ and 34′. Booster charges 32′ and 34′ communicate with the output side 36 of transfer lead charge 20 through selector chamber 38, housing blow hole 40 and transfer lead tubular housing output orifice 42.

In operation of the prior art shown in FIGS. 1–3, the mine cover that is "up" has to be ejected from a Miznay-Schardin dished liner plate located in the mine, not shown, in order for the mine to have maximum terminal effect against the target. An Interrupter ball member 44 located in selector chamber 38 drops by gravity toward the ground surface 11 covering the input side of lower MDF booster 34′ of FIG. 2 or 32′ of FIG. 3. The selected MDF booster initiates removal of either covers 10 or 12 by igniting either fuze 46 and 48 respectively leading to an ejection charge, not shown, attached to covers 10 or 12. The above sequence is initiated when microdetonator 14 is electrically activated by a target sensing means located in the mine and which is not shown in the drawing. The microdetonator 14 initiates transfer lead charge 20 which blasts into the selector chamber 38 firing the microdetonator booster 32′ or 34′ uncovered by the ball 44 to eject either the upper cover 10 or 12. The problem with the prior art design, shown in FIGS. 2 and 3, was the extremely low order of reliability for the reason previously aforementioned. The distance designated by the letter "$\theta$" is between the output side 36 of the transfer lead charge 20 and the input side 32 of the MDF booster 32′ and 34′ has been determined as being excessive and a contributing factor to poor reliability.

Figure 4:
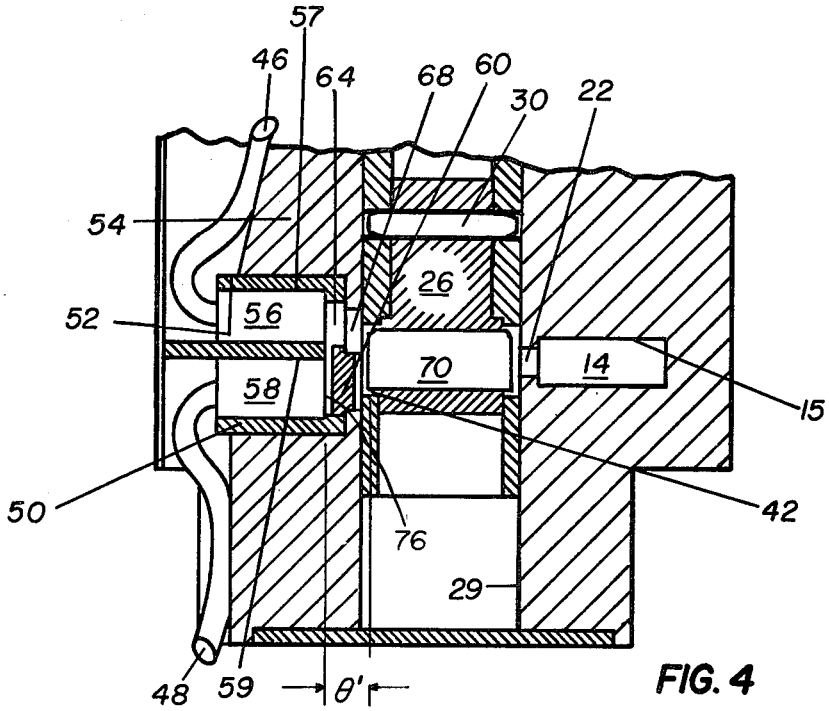
FIG. 4 is a partial cutaway cross-sectional view of the improved dual chambered primary mode explosive train of the present invention shown in a first position "A" as shown on FIG. 1.
Figure 5:
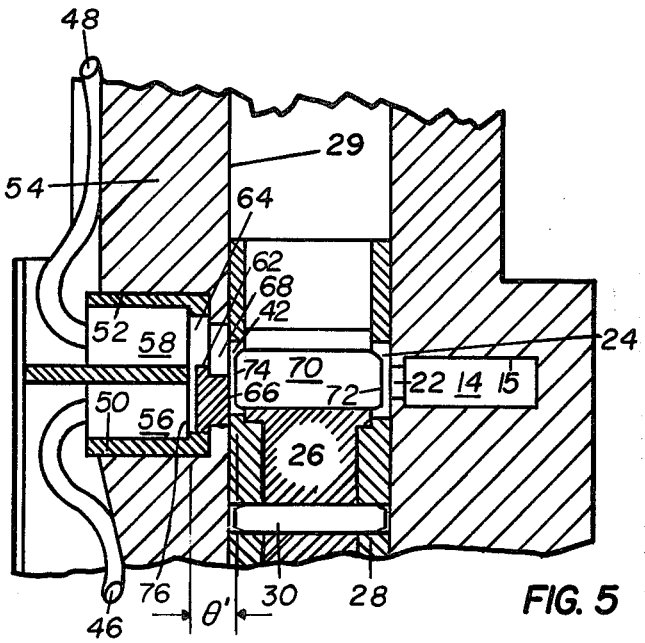
FIG. 5 is a partial cutaway cross-sectional view of the improved dual chambered primary mode explosive train of the present invention shown in a second position "B" as shown in FIG. 1.

Referring now to the present invention as illustrated by FIGS. 4 and 5 the primary mode explosive train comprises a dual chamber mild detonating fuze housing 50 transversely fixedly disposed in a second transverse counterbore hole 52 of body housing member 54. A pair of parallel aligned first and second MDF boosters 56 and 58 respectively are positioned one above each other in booster bores 57 and 59 in a rear section of the MDF housing 50. A stepped interrupted disc member 60 has larger diameter section 62 slidably positioned in chamber slot 64. The small diameter section 66 protrudes through chamber slot 64 and is slidably guided thereby while positioned in housing blow hole 68. An elongated transfer lead charge 70 is positioned in transverse lead housing 26 so that it is in axial alignment with housing blowhole 68 and body housing orifice 22, and microdetonator 14. The output side of microdetonator 14, located in a first transverse counterbore 15, communicates with the input side 72 via body housing orifice 22 and input orifice 24 of the transfer lead charge tubular member 28. Transfer lead charge housing 26 is fixedly connected to the transfer lead charge tubular member 28 by thru groove pin 30. Lead charge tubular member 28 is proximately disposed in body housing central bore 29 so that output orifice 42 is axially aligned with housing blow hole 68.

In operation when the mine lands on the ground the stepped interrupter 60 drops by gravity toward the ground, covering the booster charge 58 and uncovering the upper booster charge 56. When the microdetonator 14 is electrically signaled by a target sensing device located in the mine, and not shown, the microdetonator 14 initiates the elongated transfer lead charge 70 which in turn blasts through the output orifice 42 of tubular lead housing 28 and housing blow hole 68 into the selector chamber slot 68, firing the upper MDF booster charge 56 uncovered by interrupter 60 through a reduced standoff gap $\theta'$. Booster 56 causes ejection of round mine cover 10, shown in position "A" of FIG. 1, by igniting ejection charge lighting fuze 46. The lower MDF booster 58 of FIG. 4 is adequately covered by the flat stepped interrupter 60 and consequently will not be initiated. FIG. 5 shows the operation of the interrupter 60 when the mine's landing orientation is as shown in position "B" of FIG. 1. Under the latter condition the MDF booster 58 is uncovered and the MDF booster 56 is covered. The firing of upper MDF booster 58 by the transfer lead charge 70 in this instance ignites ejection charge lighting fuze 48 ejecting the flat mine cover 12. The gap $\theta'$ between the output side 74 and the input side of the selected MDF booster 56 or 58 has been substantially reduced in the present design of FIGS. 4 and 5 to significantly improve the reliability of the directional fuze selector apparatus by providing a more direct path for the transfer lead charge blast through the dual chamber slot 64 and housing blow hole 68 into the input side 76 of the selected MDF booster 56 or 58. The reliability of the present invention is also improved by the flat stepped interrupter disc member 60 by providing a more positive cover for the unselected MDF booster charge.

While there has been described and illustrated specific embodiments of the invention, it will be obvious that various changes, modifications and additions can be made herein without departing from the field of the invention which should by limited only by the scope of the appended claims.

Having thus fully described the invention, what is claimed as new and desired to be secured by Letters Patent of the United States is:

1. A directional fuze selector apparatus for ejecting an upwards positioned mine cover which comprises:

a body housing member having a central bore therein, first and second transverse counterbores communicating therewith, and a housing blow hole in axial alignment with said first and second transverse counterbores;

a microdetonator operatively disposed in said first transverse counter-bore;

elongated transfer lead charge means transversely positioned in said body housing member having an input side axially aligned with an output side of said microdetonator;

dual mild detonating fuze (MDF) means operatively disposed in said second transverse counterbore of said body housing member for selectively and reliably ejecting said upward positioned mine cover by substantially reducing a standoff gap distance $\theta$ between said output side of said elongated transfer lead charge and the input side of said mild detonating fuze means which includes;

a dual chamber housing fixedly positioned in said second transverse counterbore of said body housing member, said dual chamber housing having a pair of booster bores disposed one above each other in parallel alignment, and a chamber slot for slidably holding interrupter means therein;

a first mild detonating fuze (MDF) booster charge disposed in one of said pair of parallel aligned booster bores, the input side of said first MDF booster, being disposed at a substantially reduced standoff gap distance $\theta'$ from the output side of said elongated transfer lead charge means;

a second mild detonating fuze booster charge disposed in another of said pair of parallel aligned booster bores, the input side of said second MDF booster being disposed at a substantially reduced standoff gap distance $\theta'$ from the output side of said transfer lead charge means;

a first ejection charge igniting fuze operatively connected to the output side of said first mild detonating fuze booster; and a second ejection charge igniting fuze operatively connected to the output of said second mild detonating fuze booster; and gravity responsive interrupter means operatively disposed intermediate said mild detonating fuze means and the output side of said elongated transfer lead charge means for providing positive cover to prevent simultaneous firing of both elements of said dual mild detonating fuze means.

2. A directional fuze selector apparatus as recited in claim 1 whereing said gravity responsive interrupter means comprises a stepped disc member having a small diameter section slidably positioned in said chamber slot of said dual chamber housing, a large diameter section positively covering one of said unselected pair of MDF detonating fuze boosters and uncovering the other selected MDF detonating fuze booster to initiate the removal of an upsided mine cover, said stepped interrupter means preventing simultaneous ignition of said first and second MDF booster charges.

* * * * *